United States Patent [19]

Ranganathan et al.

[11] 4,435,280

[45] Mar. 6, 1984

[54] HYDROCRACKING OF HEAVY HYDROCARBON OILS WITH HIGH PITCH CONVERSION

[75] Inventors: Ramaswami Ranganathan, Regina; David J. Patmore, Ottawa; Adolfo E. Silva, Calgary, all of Canada

[73] Assignee: Her Majesty the Queen in right of Canada, as represented by the Minister of Energy, Ottawa, Canada

[21] Appl. No.: 429,683

[22] Filed: Sep. 30, 1982

[30] Foreign Application Priority Data

Oct. 7, 1981 [CA] Canada ..... 387463

[51] Int. Cl.[3] ..... C10G 47/02

[52] U.S. Cl. ..... 208/112; 208/107; 208/108; 208/251 H; 208/10

[58] Field of Search ..... 208/107, 112, 127, 251 R, 208/108, 111, 110, 251 H, 253, 10

[56] References Cited

U.S. PATENT DOCUMENTS

| | | | |
|---|---|---|---|
| 3,856,658 | 12/1974 | Wolk et al. | 208/10 |
| 4,094,766 | 6/1978 | Gorin | 208/10 |
| 4,113,602 | 9/1978 | Gorbarty et al. | 208/127 |
| 4,152,244 | 5/1979 | Raichle et al. | 208/10 |
| 4,214,977 | 7/1980 | Ranganathan et al. | 208/108 |
| 4,285,803 | 8/1981 | Braun et al. | 208/112 |
| 4,299,685 | 11/1981 | Khulbe et al. | 208/112 |
| 4,370,221 | 1/1983 | Patmore et al. | 208/112 |

*Primary Examiner*—Delbert E. Gantz
*Assistant Examiner*—Anthony McFarlane
*Attorney, Agent, or Firm*—Finnegan, Henderson, Farabow, Garrett & Dunner

[57] ABSTRACT

A process is described for the hydrocracking of heavy hydrocarbon oils which permits pitch conversions of over 90%, and preferably over 95%. A slurry of a heavy hydrocarbon oil and carbonaceous additive particles, such as coal, is passed in the presence of hydrogen through a confined vertical hydrocracking zone at high temperatures and pressures. An effluent which is almost entirely a gaseous phase is removed from the top of the hydrocracking zone, while a drag stream is removed from the remaining liquid in the hydrocracking zone. The top effluent has the advantage of being substantially free of pitch and metals, with the unreacted carbonaceous additives, metals and any unconverted pitch being all concentrated in the drag stream.

11 Claims, 1 Drawing Figure

HYDROCRACKING OF HEAVY HYDROCARBON OILS WITH HIGH PITCH CONVERSION

Figure 1:
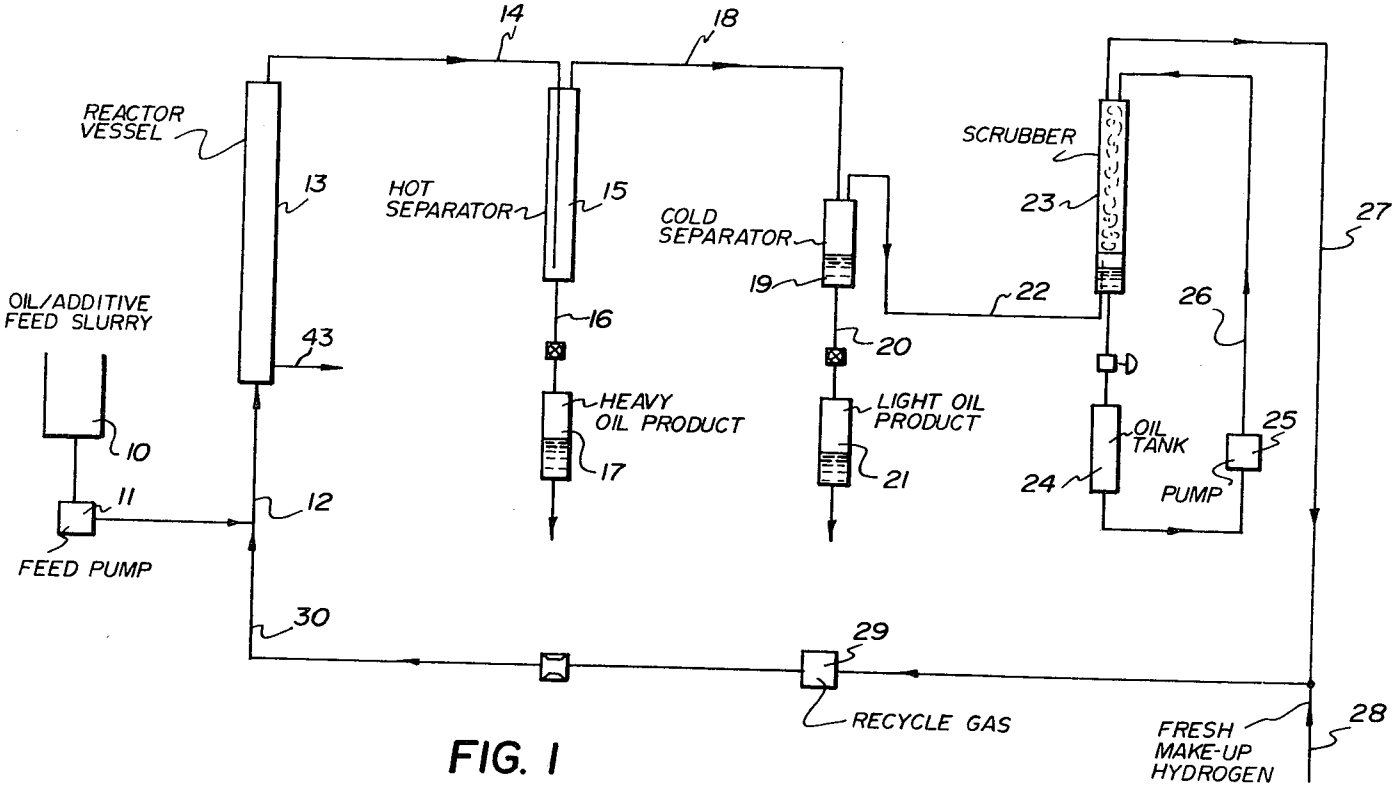

This invention relates to hydrocracking and, more particularly, to hydrocracking of a heavy hydrocarbon oil, such as bitumen from tar sands, with substantially complete conversion of the pitch fraction to distillate fractions.

Hydrocracking processes for the conversion of heavy hydrocarbon oils to light and intermediate naphthas of good quality for reforming feed stock, fuel oil and gas oil are well known. These heavy hydrocarbon oils can be such materials as petroleum crude oil, atmospheric tar bottoms products, vacuum tar bottoms products, heavy cycle oils, shale oils, coal derived fluids, crude oil residuum, topped crude oils and the heavy bituminous oils, such as those extracted from tar sands. Of particular interest are the oils extracted from tar sands which contain wide boiling range materials from naphtha through kerosene, gas oil, pitch, etc., and which contain a large portion, usually more than 50 weight percent of material boiling above 524° C., equivalent atmospheric boiling point.

The heavy hydrocarbon oils of the above type tend to contain nitrogeneous and sulphurous compounds in quite large concentrations. In addition, such heavy hydrocarbon fractions frequently contain excessive quantities of organo-metallic contaminants which tend to be extremely detrimental to various catalytic processes that may subsequently be carried out, such as hydrofining. Of the metallic contaminants, those containing nickel and vanadium are most common, although other metals are often present. These metallic contaminants, as well as others, are chemically bound to organic molecules of relatively high molecular weight which are present in the bituminous material. A considerable quantity of the metal complexes is linked with asphaltenic material and contains sulphur. Of course, in catalytic hydrocracking procedures, the presence of large quantities of asphaltenic material and organically bound metal compounds interferes considerably with the activity of the catalyst with respect to the destructive removal of nitrogen, sulphur and oxygen-containing compounds. A typical Athabasca bitumen may contain 53.76 wt.% pitch (material boiling above 524° C.), 4.74 wt.% sulphur, 0.59 wt.% nitrogen, 276 ppm vanadium and 80 ppm nickel, while a typical Cold Lake bitumen may contain 73 wt.% pitch.

As the reserves of conventional crude oils decline, these heavy oils must be upgraded to meet the demands. In this upgrading, the heavier material is converted to lighter fractions and most of the sulfur, nitrogen and metals must be removed. This is usually done by a coking process such as delayed or fluidized coking or by a hydrogen addition process such as thermal or catalytic hydrocracking. The distillate yield from the coking process is about 70 weight percent and this process also yields about 23 wt.% coke as by-product which cannot be used as fuel because of low hydrogen:carbon ratio, and high mineral and sulfur content. Depending on operating conditions, hydrogenation processes can give a distillate yield of over 87 wt.%

It has been shown in Ternan et al, Canadian Pat. No. 1,073,389 issued Mar. 10, 1980 and Ranganathan et al., U.S. Pat. No. 4,214,977 issued July 29, 1980, that the addition of coal or coal-based catalyst results in a reduction of coke deposition during hydrocracking and allows operation at low pressures. The coal additives act as sites for the deposition of coke precursors and thus provide a mechanism for their removal from the system.

As has been shown in the above patents, the operating costs can be reduced by using cheap throwaway type catalysts and, for instance, U.S. Pat. No. 4,214,977 describes the use of iron-coal catalyst which enables operation at lower pressures and at higher conversions. The use of coal and Co, Mo and Al on coal catalysts are described in Canadian Pat. No. 1,073,389.

It is the object of the present invention to utilize a relatively inexpensive disposable carbon-based additive in a heavy hydrocarbon oil feedstock for hydrocracking the heavy oil with substantially complete conversion of the pitch fraction to distillate fractions.

SUMMARY OF THE INVENTION

In accordance with the present invention, there is described a process for hydrocracking a heavy hydrocarbon oil containing a substantial portion of pitch which boils above 524° C., which comprises:

(a) passing a slurry feed of said heavy hydrocarbon oil and from about 0.01–60 wt. % of carbonaceous additive particles in the presence of hydrogen upwardly through a confined vertical hydrocracking zone, said hydrocracking zone being maintained at a temperature between about 400° and 500° C., a pressure of at least 3.5 MPa and a space velocity between about 0.25 and 4 volumes of hydrocarbon oil per hour per volume of hydrocracking zone capacity, (b) removing from the top of said hydrocracking zone a vaporous effluent comprising hydrogen and vaporous hydrocarbons and being substantially free of pitch and metals, and (c) removing from the remaining liquid in the hydrocracking zone a liquid drag stream comprising carbonaceous additives, metals and any unconverted pitch.

When a carbonaceous material, such as coal is simultaneously hydrogenated with a heavy hydrocarbon oil, it undergoes liquifaction leaving behind particles consisting of carbonaceous material plus mineral matter which are inert to further hydrogenation. These particles have been found to be active sites for the deposition of metal compounds produced during hydrocracking of heavy hydrocarbon oils. An equilibrium bed of these inert carbonaceous particles is gradually established in the reactor during continuous operation.

In accordance with this invention, substantially all of the liquid material produced during the hydrocracking is withdrawn in a drag stream from the reactor, so that the products coming off at the top of the reactor contain mainly vaporous hydrocarbons. As the conversion approaches 100 wt.%, the drag stream contains mostly unconverted coal based additives, metals, and some heavy liquid from coal and/or pitch. The drag stream can be taken out from different locations in the reactor, e.g. using an internal liquid/vapor separator to control the liquid level and solid concentration in the reactor.

The drag stream can be recovered for use as pitch binder or as a source of metals. Also, since the drag stream contains most of the coal based additive, it can be recycled in whole or in part with the feedstock to the hydrocracking zone.

Since the product coming off at the top of the reactor contains only vaporous hydrocarbons and is substantially free of pitch and metals, it can be sent directly to secondary refining without further distillation. However, in some situations some coal based additive may come over with the reactor product and this additive can be separated using cyclone separators.

While the system of this invention can be advantageously operated over a wide range of pitch conversions, it is generally operated at a pitch conversion of over 90% and preferably over 95%. Although 100% conversion is possible, because of the requirement to maintain solids balance in the reactor, the maximum practical pitch conversion for commercial operations is about 98%.

It has been found that with the high conversion system of this invention, there is an increased production of naphtha ($C_4$–205° C.) and light gas oil (205°–345° C.) fractions at the expense of the heavy oil (345°–524° C.) fraction and pitch fraction. Furthermore, it has been found that both the wt.% and vol.% liquid distillate yields ($C_4$–524° C. fractions) continued to increase with increased pitch conversion. It was also found that hydrogen is selectively consumed in the distillate fractions rather than in the pitch fraction.

While the process of this invention is particularly well suited for the treatment of bitumen or heavy oil containing at least 50% pitch which boils above 524° C., it is also very well suited for the treatment of topped bitumen, topped heavy oil or residuum. It can be operated at quite moderate pressures, e.g. in the range of 3.5 to 24 MPa, without coke formation in the hydrocracking zone and is preferably carried out in the presence of 14 to 1400 $m^3$ hydrogen per barrel of heavy hydrocarbon oil.

The hydrocracking process of this invention can be carried out in a variety of known reactors. The empty tubular reactor has been found to be particularly convenient with the effluent from the top being separated in a hot separator and the gaseous stream from the hot separator being fed to a low temperature-high pressure separator where it is separated into a gaseous stream containing hydrogen and lesser amounts of gaseous hydrocarbons and a liquid product stream containing light oil products.

The carbonaceous additive particles can be selected from a wide range of materials, with their main requirement being that they be capable of providing a porous network for the deposition of the metal-rich residues from hydrocracking of the heavy hydrocarbon oils. Coals are particularly well suited for this purpose, with sub-bituminous coal being particularly preferred. Other carbonaceous additives that may be used include a fly ash obtained from burning of delayed bitumen coke. This fly ash contains in excess of 20% unburnt carbon and has been found to be highly porous. Other additives may include coal washery rejects, pulverized coke, pyrites, lignite and anthracites.

The carbonaceous additive can be used as is without any additive or it may be coated with metal salts such as iron, cobalt, molybdenum, zine, tin, tungsten, nickel or other catalytically active salts. The use of the catalytic materials improve the conversion of heavy oil as well as the operability of the process, but the metal loading must depend on the cost of materials, tolerable ash content and optimum catalyst activity.

The catalyst can be coated on the carbonaceous particles by spraying the aqueous solution of the metal salt on the coal particles. The particles are then dried to reduce the moisture content before blending with the feed stock.

The carbonaceous, e.g., coal particles used may be quite small, e.g. usually less than 60 mesh (Canadian Standard Sieve) although larger sizes up to ½" in diameter may be used in very large commercial installations. The additive should be mixed with the bitumen, preferably in an amount of 0.1 to 20 wt.%, in such a manner as to avoid formation of lumps, and, if desired, additional homogeneous or heterogeneous catalysts may be mixed with the additive bitumen slurry.

According to a preferred embodiment, the bitumen and additive, e.g. coal, are mixed in a feed tank and pumped with hydrogen through a heater and up through a vertical empty tube reactor. The liquid level and the solids content of the reactor are controlled by drawing off a drag stream such that the effluent from the top of the reactor is substantially all in the vapour phase. The gaseous effluent from the top of the hydrocracking zone is separated in a hot separator maintained at a temperature in the range of about 200°–470° C. and at the pressure of the hydrocracking zone.

The gaseous stream from the hot separator containing a mixture of hydrocarbon gases and hydrogen is further cooled and separated in a low temperature-high pressure separator. By using this type of separator, the outlet gaseous stream obtained contains mostly hydrogen with some impurities such as hydrogen sulfide and light hydrocarbon gases. This gaseous stream is passed through a scrubber and the scrubbed hydrogen is recycled as part of the hydrogen feed to the hydrocracking process. The recycled hydrogen gas purity is maintained by adjusting scrubbing conditions and by adding make-up hydrogen.

The liquid stream from the low temperature-high pressure separator represents the light hydrocarbon product of the present process and can be sent for secondary treatment.

For a better understanding of the present invention, reference is made to the accompanying drawings in which:

FIG. 1 is a schematic flow sheet of one preferred embodiment of the invention.

As shown in FIG. 1, heavy hydrocarbon oil feed and coal or other carbonaceous additive are mixed together in a feed tank 10 to form a slurry. This slurry is pumped via feed pump 11 through inlet line 12 into the bottom of an empty tower 13. Recycled hydrogen and make up hydrogen from line 30 is simultaneously fed into the tower 13 through line 12. A drag stream containing mostly unconverted coal based additives, metals and some heavy liquid from coal and/or pitch is withdrawn from tower 13 through line 43. A gaseous effluent is withdrawn from the top of the tower through line 14 and introduced into a hot separator 15. In the hot separator the effluent from tower 13 is separated into a gaseous stream 18 and a liquid stream 16, The liquid stream 16 is in the form of heavy oil which is collected at 17.

The gaseous stream from hot separator 15 is carried by way of line 18 into a high pressure-low temperature separator 19. Within this separator the product is separated into a gaseous stream rich in hydrogen which is drawn off through line 22 and an oil product which is drawn off through line 20 and collected at 21.

The hydrogen rich stream 22 is passed through a packed scrubbing tower 23 where it is scrubbed by means of a scrubbing liquid 24 which is cycled through the tower by means of pump 25 and recycle loop 26. The scrubbed hydrogen rich stream emerges from the scrubber via line 27 and is combined with fresh make up hydrogen added through line 28 and recycled through recycle gas pump 29 and line 30 back to tower 13.

Certain preferred embodiments of this invention will now be further illustrated by the following non-limitative examples. For these examples the feedstock used was a Cold Lake Vacuum Residuum obtained from Imperial Oil Ltd. The properties of this feedstock are given in Table 1.

The additive used was a sub-bituminous coal which was crushed and screened to provide a minus 200 mesh material. The coal additive was treated with metal salts. This was done by spraying an aqueous solution of $FeSO_4$ on the coal particles and then drying the coal to reduce the moisture content before blending with the feedstock. The dried material contained 31% by weight of hydrated $FeSO_4$ on coal (dry basis).

The properties of the additive used are set out in Table 2 below.

TABLE 1

Properties of Cold Lake Vacuum Resid

| | | |
|---|---|---|
| Gravity, | °API | 6.41 |
| Specific gravity | 60/60° F. | 1.026 |
| Sulphur, | wt % | 5.16 |
| Ash, | wt % | 0.064 |
| C.C.R. | wt % | 18.2 |
| Pentane insolubles, | wt % | 21.0 |
| Asphaltenes, | wt % | 21.0 |
| Toluene insolubles, | wt % | 0.03 |
| Carbon, | wt % | 82.93 |
| Hydrogen, | wt % | 10.29 |
| Nitrogen, | wt % | 0.57 |
| Vanadium, | ppm | 255 |
| Nickel, | ppm | 92 |
| Iron, | ppm | 10 |
| Sediment (extraction) | wt % | 0.02 |
| Water (distillation) | wt % | nil |
| Viscosity, | cSt @ 180° F. | 5270 |
| Viscosity, | cSt @ 210° F. | 1489 |
| Pitch | wt % 73.00 | |

TABLE 2

Properties of the Coal/$FeSO_4$ Additive

| | | $FeSO_4$/Coal Catalyst |
|---|---|---|
| Moisture | % | 7.70 |
| Ash | % | 20.03 |
| Carbon | % | 45.16 |
| Hydrogen | % | 3.52 |
| Sulphur | % | 4.23 |
| Nitrogen | % | 0.53 |
| Ash Analysis | | |
| (based on $FeSO_4$/Coal) | | |
| $SiO_2$ | % | 3.19 |
| $Al_2O_3$ | % | 1.90 |
| Fe | % | 6.89 |
| Ti | % | 0.05 |
| $P_2O_5$ | % | 0.01 |
| CaO | % | 1.31 |
| MgO | % | 0.43 |
| $SO_3$ | % | 2.28 |
| $Na_2O$ | % | 0.03 |
| $K_2O$ | % | 0.01 |
| SrO | % | 0.00 |
| BaO | % | 0.04 |
| Loss on Fusion | % | 1.68 |

EXAMPLE 1

A blended slurry of Cold Lake Vacuum residuum and 1% by weight of the coal/$FeSO_4$ additive was prepared and this slurry was used as a feedstock to a hydrocracking plant as illustrated in FIG. 1 of the drawings. The pilot plant used the reaction sequence shown in the drawing with a reactor vessel having a height of 4.3 m and was operated under the reaction conditions in Table 3 below:

TABLE 3

Operating Conditions for Hydrocracking Experiments

| Run No. | | 34 | 36 | 38 |
|---|---|---|---|---|
| Reaction Temp. (Nominal) | °C. | 452 | 456 | 465 |
| Hot Separator Temp. (average) | °C. | 370 | 366 | 368/352 |
| Gas Rate | $m^3$/hr (API) | 5.856 | 5.856 | 5.856 |
| Hydrogen Purity | vol % | 85 | 85 | 85 |
| Hydrogen Consumption | $m^3$/t (API) | 219.95 | 237.07 | 308.49 |
| Feed Rate | kg/hr | 3.375 | 3.474 | 3.282 |
| L.H.S.V. (Nominal) | | 0.75 | 0.75 | 0.75 |
| Length of Run | hr | 18 | 20 | 92 |
| System Pressure | MPa | 13.89 | 13.89 | 13.89 |

Withdrawal of liquid material from the reactor was accomplished through a series of sampling ports located along the reactor vessel 13. This liquid withdrawal was used to control solids concentration in the reactor and substantially all liquid resulting from the hydrocracking was removed with the drag stream. Under these operational conditions, almost all of the original heavy oil was in the vapour phase at the top levels of the reactor so that only condensed vapour was collected in the hot separator, resulting in pitch-free and metals-free heavy oil product.

The product yields and conversion are given in Table 4 below, while the product quality data for total distillate and distillate fractions are given in Tables 5 to 9 below.

TABLE 4

Yields and Conversions of Gas and Liquid Products

| Run No. | | 34 | 36 | 38 |
|---|---|---|---|---|
| Pitch Conversion, | wt % | 89.39 | 92.69 | 100.0 |
| Sulphur Conversion, | wt % | 62.91 | 66.99 | 75.65 |
| Total Liquid Yield, vol % feed | ($C_4$+) | 106.39 | 103.85 | 105.62 |
| Total Liquid Yield, wt % feed | ($C_4$+) | 92.97 | 90.23 | 88.91 |
| Hydrogen Consumption, | $m^3$(API)/t | 226.56 | 244.01 | 308.49 |
| H-C Gas Make, | $m^3$(API)/t | 68.43 | 70.69 | 101.00 |
| Hydrogen Fed, wt % feed | | 2.28 | 2.41 | 3.02 |
| Total H-C Gas Yield, wt % feed | | 8.86 | 8.94 | 12.50 |
| $C_4$ + Gas Yield, wt % feed | | 2.56 | 2.33 | 3.05 |
| $H_2S$ Yield, wt % feed | | 3.45 | 3.67 | 4.15 |

TABLE 5

Properties of Total Distillate ($C_4$-524° C.)

| Run No. | | 34 | 36 | 38 |
|---|---|---|---|---|
| Wt % of Feed | | 85.19 | 84.83 | 88.91 |
| Vol % of Feed | | 99.86 | 99.40 | 105.62 |
| Specific gravity, | 15/15° C. | 0.875 | 0.875 | 0.862 |
| Gravity, | °API | 30.21 | 30.21 | 32.65 |
| Sulphur, | wt % | 2.08 | 2.14 | 1.42 |
| Carbon, | wt % | 85.54 | 85.82 | 84.92 |
| Hydrogen, | wt % | 12.11 | 12.13 | 12.15 |
| Nitrogen, | wt % | 0.25 | 0.28 | 0.30 |
| H/C Atomic Ratio | | 1.70 | 1.70 | 1.72 |
| Viscosity @ 40° C. | cSt | 3.79 | 3.52 | 2.69 |

TABLE 6

Properties of Naphtha ($C_4$-205° C.)

| Run No. | 34 | 36 | 38 |
|---|---|---|---|
| Wt % of Feed | 20.98 | 21.04 | 25.88 |
| Vol % of Feed | 29.45 | 29.51 | 36.20 |
| Vol % of Total Distillate | 29.50 | 29.69 | 34.27 |

TABLE 6-continued

| Properties of Naphtha ($C_4$-205° C.) | | | | |
|---|---|---|---|---|
| Run No. | | 34 | 36 | 38 |
| Gravity | °API | 61.92 | 62.18 | 62.27 |
| Specific gravity, | 15/15° C. | 0.732 | 0.731 | 0.730 |
| Sulphur, | wt % | 0.71 | 0.64 | 0.31 |
| Carbon, | wt % | 85.73 | 85.95 | 85.16 |
| Hydrogen, | wt % | 14.20 | 13.95 | 14.26 |
| Nitrogen, | wt % | 0.07 | 0.07 | 0.079 |
| H/C Atomic Ratio, | | 1.99 | 1.95 | 2.01 |
| Aniline Point, | °C. | 49.3 | 49.4 | 50.0 |
| Bromine No. | | 41 | 38 | 29 |
| Diene Value (UOP Method, 326-58) | | — | — | 1.78 |
| Paraffins | wt % | 38 | 42 | 39 |
| Naphthenes | wt % | 26 | 26 | 27 |
| Aromatics | wt % | 11 | 12 | 15 |
| Olefins | wt % | 25 | 20 | 19 |

TABLE 7

| Properties of Light Gas Oil (205-345° C.) | | | | |
|---|---|---|---|---|
| Run No. | | 34 | 36 | 38 |
| Wt % of Feed | | 31.38 | 33.21 | 35.60 |
| Vol % of Feed | | 36.25 | 38.33 | 41.23 |
| Vol % of Total Distillate | | 36.31 | 38.56 | 39.04 |
| Gravity | °API | 27.85 | 27.85 | 29.11 |
| Specific gravity, | 15/15° C. | 0.888 | 0.888 | 0.881 |
| Sulphur, | wt % | 2.29 | 2.17 | 1.65 |
| Carbon, | wt % | 86.05 | 86.19 | 85.48 |
| Hydrogen, | wt % | 12.10 | 11.81 | 12.31 |
| Nitrogen, | wt % | 0.18 | 0.20 | 0.23 |
| H/C Atomic Ratio, | | 1.69 | 1.64 | 1.73 |
| Aniline Point, | °C. | 50.0 | 49.7 | 48.4 |
| Bromine No. | | 20 | 20 | 18 |
| Diene Value (UOP Method, 326-58) | | — | — | 3.68 |
| Pour Point, | °F. | −10 | −5 | −15 |
| Paraffins, | wt % | 20 | 17 | 29 |
| Naphthenes, | wt % | 26 | 27 | 38 |
| Aromatics, | wt % | 50 | 52 | 31 |
| Olefins, | wt % | 3.8 | 6.0 | 2.1 |

TABLE 8

| Properties of Heavy Gas Oil (345-524° C.) | | | | |
|---|---|---|---|---|
| Run No. | | 34 | 36 | 38 |
| Wt % of Feed | | 32.83 | 30.58 | 27.43 |
| Vol % of Feed | | 34.15 | 31.56 | 28.19 |
| Vol % of Total Distillate | | 34.20 | 31.75 | 26.69 |
| Gravity | °API | 12.01 | 11.00 | 11.00 |
| Specific gravity, | 15/15° C. | 0.986 | 0.993 | 0.993 |
| Sulfur, | wt % | 2.49 | 2.43 | 1.87 |
| Carbon, | wt % | 84.90 | 84.92 | 86.73 |
| Hydrogen, | wt % | 10.02 | 9.97 | 9.97 |
| Nitrogen, | wt % | 0.52 | 0.52 | 0.56 |
| H/C Atomic Ratio, | | 1.42 | 1.41 | 1.38 |
| C.C.R., | wt % | 1.39 | 1.67 | 1.08 |
| Pentane insolubles, | wt % | 0.66 | 0.84 | 1.22 |
| Toluene insolubles, | wt % | trace | trace | 0.16 |
| Viscosity @ 40° C. | cSt | 98.49 | 97.31 | 63.35 |

TABLE 9

| Properties of Pitch (524° C.+) | | | |
|---|---|---|---|
| Run No. | | 34 | 36 |
| Wt % of Feed | | 7.77 | 5.35 |
| Vol % of Feed | | 6.55 | 4.38 |
| Specific gravity, | 15/15° C. | 1.23 | 1.27 |
| Sulphur, | wt % | 3.27 | 2.98 |
| Carbon, | wt % | 87.46 | 87.85 |
| Hydrogen, | wt % | 6.84 | 6.22 |
| Nitrogen, | wt % | 1.71 | 1.91 |
| H/C Atomic Ratio, | | 0.94 | 0.85 |
| C.C.R., | wt % | 66.1 | 64.2 |
| Ash, | wt % | — | 0.06 |
| Pentane insolubles, | wt % | 81.2 | 89.7 |

TABLE 9-continued

| Properties of Pitch (524° C.+) | | | |
|---|---|---|---|
| Run No. | | 34 | 36 |
| Toluene insolubles, | wt % | 16.3 | 15.0 |
| Asphaltenes, | wt % | 64.9 | 74.7 |
| TIOR, | wt % | — | 74.6 |

When the system of this invention was operated at pitch conversions above 95 wt.%, all of the refractory hydrocarbons, metals and ash were concentrated in the drag stream. The typical properties of a drag stream from the reactor for a pitch conversion of 95-98 wt.% are given in Table 10 below:

TABLE 10

| Properties of a Typical Drag Stream | | |
|---|---|---|
| Specific gravity, | 15/15° C. | 1.38 |
| Sulphur, | wt % | 5.40 |
| Ash, | wt % | 13.0 |
| Pentane insolubles, | wt % | 89.0 |
| Toluene insolubles, | wt % | 52.2 |
| Vanadium, | wt % | 1.2 |
| Nickel, | wt % | 0.42 |
| Iron, | wt % | 3.8 |
| Carbon, | wt % | 77.08 |
| Hydrogen, | wt % | 5.26 |
| Nitrogen, | wt % | 1.23 |

We claim:

1. A process for hydrocracking a heavy hydrocarbon oil containing a substantial portion of pitch which boils above 524° C., which comprises:

(a) passing a slurry feed of said heavy hydrocarbon oil and from about 0.01-60 wt.% of carbonaceous additive particles in the presence of hydrogen upwardly through a confined vertical hydrocracking zone, said hydrocracking zone being maintained at a temperature between about 350° and 500° C., a pressure of at least 3.5 MPa and a space velocity of up to 4 volumes of hydrocarbon oil per hour per volume of hydrocracking zone capacity, (b) removing from the top of said hydrocracking zone a vaporous effluent comprising hydrogen and vaporous hydrocarbons and being substantially free of pitch and metals, and (c) removing from the remaining liquid in the hydrocracking zone a drag stream comprising carbonaceous additive, metals and any unconverted pitch, the products coming off at the top of the reactor containing substantially only vaporous hydrocarbons and the drag stream containing substantially all of the liquid material produced during the hydrocracking whereby a pitch conversion of over 90% is achieved.

2. A process according to claim 1 wherein the heavy hydrocarbon oil feed contains at least 50 wt.% pitch which boils above 524° C.

3. A process according to claim 2 wherein the additive particles are selected from coal, fly ash, coal washery rejects, pulverized coke, pyrites, lignite and anthracites.

4. A process according to claim 2 wherein the carbonaceous additive particles are coal particles.

5. A process according to claim 4 wherein the coal particles are treated with a metal salt selected from iron, cobalt, molybdenum, zinc, tin, tungsten and nickel salts.

6. A process according to claim 2 wherein the feed slurry contains about 0.1 to 20 wt.% carbonaceous additive particles.

7. A process according to claim 2 wherein any carbonaceous additive particles and pitch entrained in the vaporous effluent are separated from the effluent using a cyclone separator.

8. A process according to claim 2 wherein the vaporous effluent is separated in a hot separator into a heavy hydrocarbon product stream which is substantially free of pitch and metals and a gaseous stream containing a mixture of hydrocarbon gases and hydrogen.

9. A process according to claim 8 wherein the gaseous stream from the hot separator is separated in a low temperature-high pressure separator into a gaseous stream containing mostly hydrogen with some impurities and light hydrocarbon gases and a light hydrocarbon liquid product stream.

10. A process according to claim 2 wherein the hydrocracking temperature and the space velocity are controlled and all liquid forming in the hydrocracking zone is removed via the drag stream to obtain a pitch conversion of at least 95%.

11. A process according to claim 2 wherein at least part of the drag stream is recycled to the feed slurry.

* * * * *

UNITED STATES PATENT AND TRADEMARK OFFICE

CERTIFICATE OF CORRECTION

PATENT NO. : 4,435,280

DATED : March 6, 1984

INVENTOR(S) : Ramaswami Ranganathan et al.

It is certified that error appears in the above—identified patent and that said Letters Patent is hereby corrected as shown below:

Column 8, line 47 "additive" should read --additives--.

Signed and Sealed this

*Twenty-third* Day of *October 1984*

[SEAL]

*Attest:*

GERALD J. MOSSINGHOFF

*Attesting Officer*

*Commissioner of Patents and Trademarks*